US007779642B2

(12) United States Patent
Bae et al.

(10) Patent No.: US 7,779,642 B2
(45) Date of Patent: Aug. 24, 2010

(54) AIR CONDITIONER AND DRIVING METHOD THEREOF

(75) Inventors: Young-Ju Bae, Gyeongsangnam-Do (KR); Seung-Jun Lee, Gyeongsangnam-Do (KR); Joon-Hong Park, Busan (KR); Kang-Wook Cha, Gyeongsangnam-Do (KR); Seung-Mun An, Busan (KR)

(73) Assignee: LG Electronics Inc., Seoul (KR)

( * ) Notice: Subject to any disclaimer, the term of this patent is extended or adjusted under 35 U.S.C. 154(b) by 506 days.

(21) Appl. No.: 11/793,151

(22) PCT Filed: Dec. 14, 2004

(86) PCT No.: PCT/KR2004/003289

§ 371 (c)(1),
(2), (4) Date: Jun. 14, 2007

(87) PCT Pub. No.: WO2006/064984

PCT Pub. Date: Jun. 22, 2006

(65) Prior Publication Data

US 2008/0087033 A1 Apr. 17, 2008

(51) Int. Cl.
*F25B 7/00* (2006.01)

(52) U.S. Cl. ..... 62/175; 62/510

(58) Field of Classification Search ..... 62/175, 62/332, 335, 196.2, 510
See application file for complete search history.

(56) References Cited

U.S. PATENT DOCUMENTS

| | | | | |
|---|---|---|---|---|
| 4,306,420 | A * | 12/1981 | Cann | 62/196.2 |
| 2,938,361 | A | 5/1990 | McNatt | |
| 5,094,085 | A * | 3/1992 | Irino | 62/175 |
| 6,305,187 | B1 | 10/2001 | Tsuboe | |
| 6,651,458 | B1 * | 11/2003 | Ebara et al. | 62/510 |
| 7,028,491 | B2 * | 4/2006 | Horton | 62/158 |
| 7,272,948 | B2 * | 9/2007 | Taras et al. | 62/324.1 |

* cited by examiner

*Primary Examiner*—George Nguyen
(74) *Attorney, Agent, or Firm*—McKenna Long & Aldridge LLP

(57) ABSTRACT

An air conditioner comprises: a first compression unit (C1) and a second compression unit (C2) for respectively compressing a refrigerant; an outdoor heat exchanger (200) provided at an outdoor unit and connected via the secondcontrol valve (400) to the first compression unit (C1) and the second compression unit (C2); and indoor heat exchanger (100) provided at an indoor unit is connected via the secondcontrol valve (400) to the first compression unit (C1) and the second compression unit (C2) and via the expansion valve (700) to the outdoor heat exchanger; and a first control valve (500) for controlling a refrigerant flow by selectively connecting the first compression unit (C1) and the second compression unit (C2) in series or in parallel. As the first compression unit (C1) and the second compression unit (C2) are selectively connected to each other in series or in parallel, a capacity of the air conditioner is varied according to a change of an indoor temperature and fabrication cost is minimized.

14 Claims, 7 Drawing Sheets

[Fig. 1]
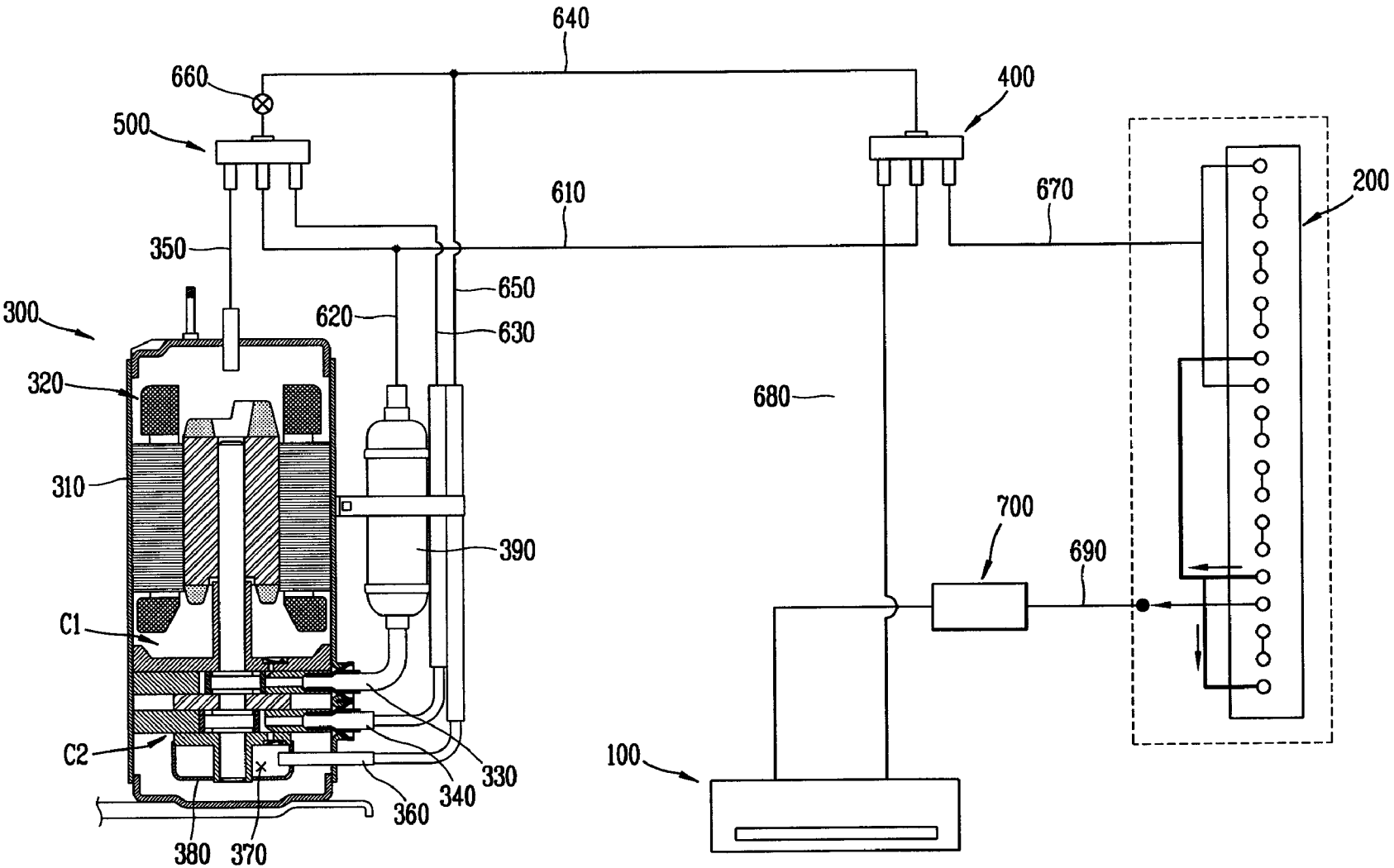

[Fig. 2]
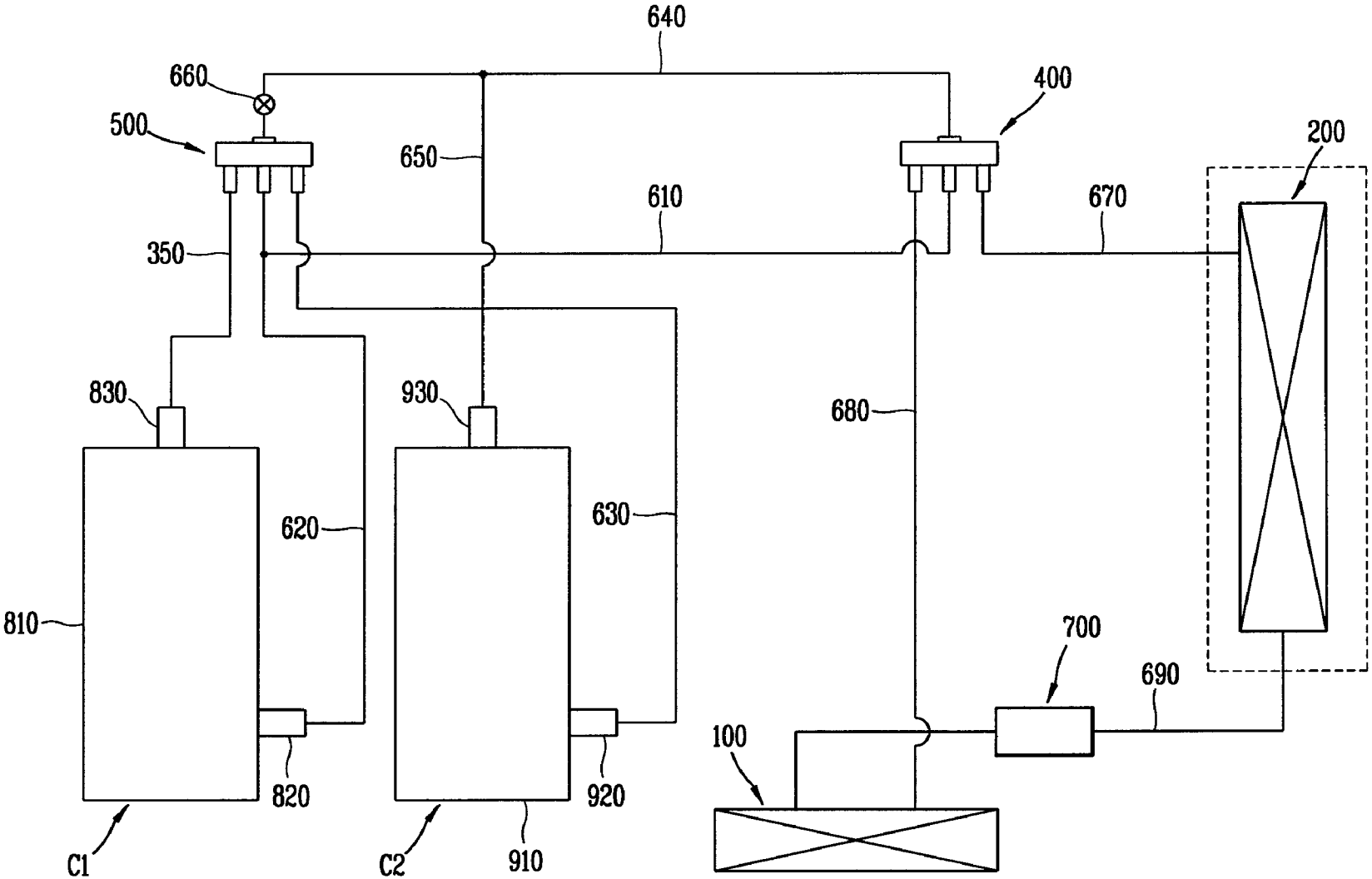

[Fig. 3]
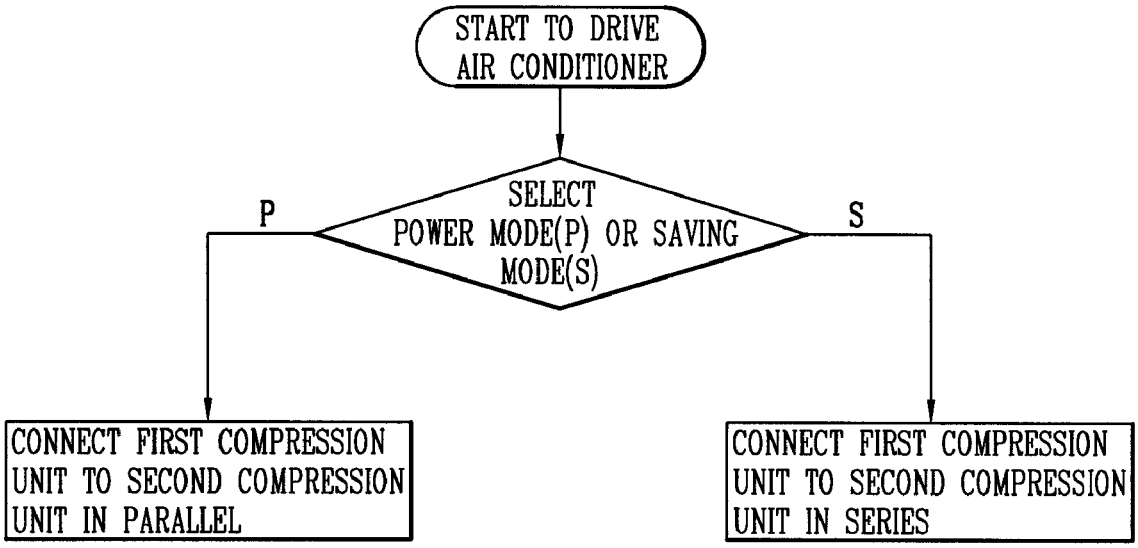

[Fig. 4]
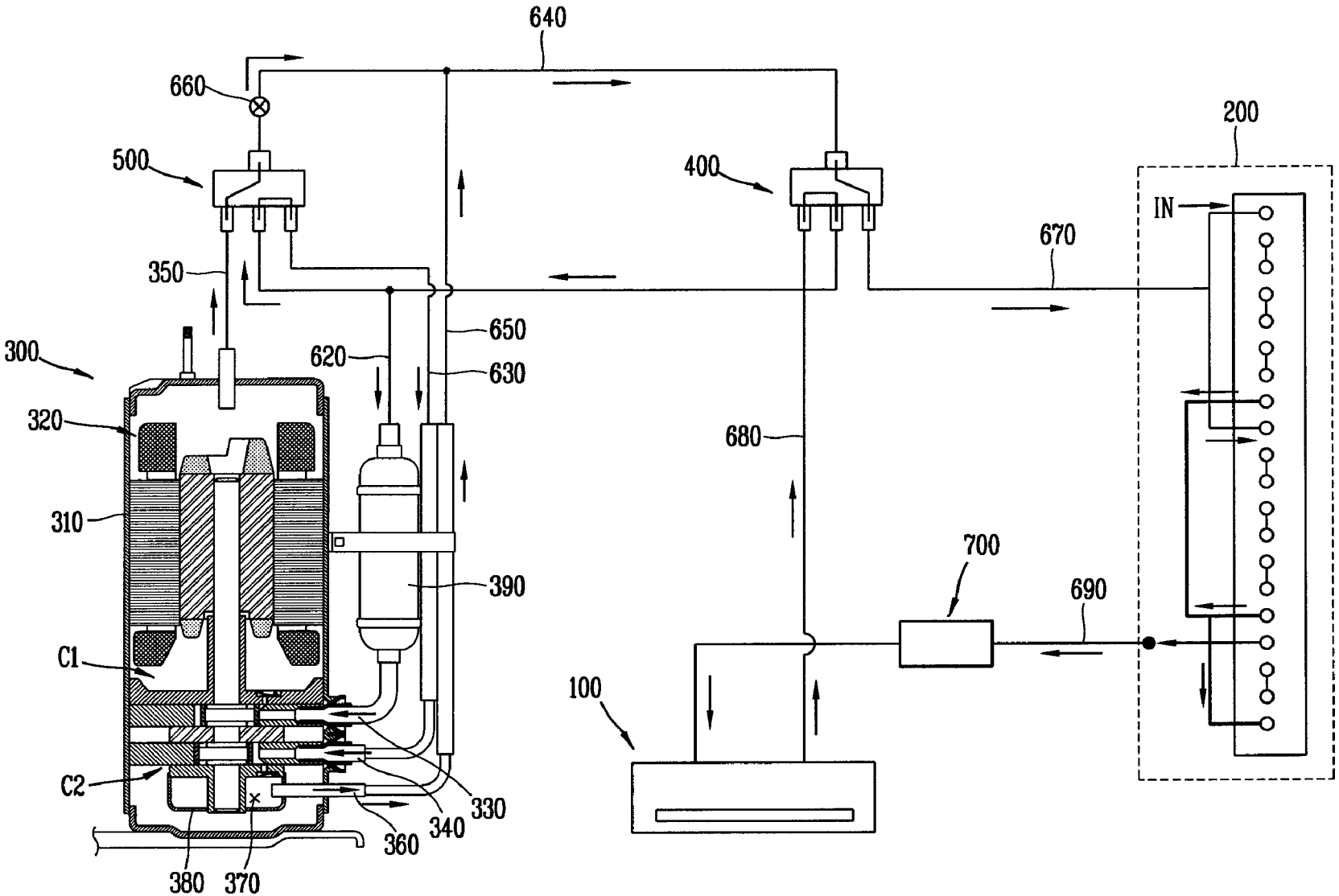

[Fig. 5]
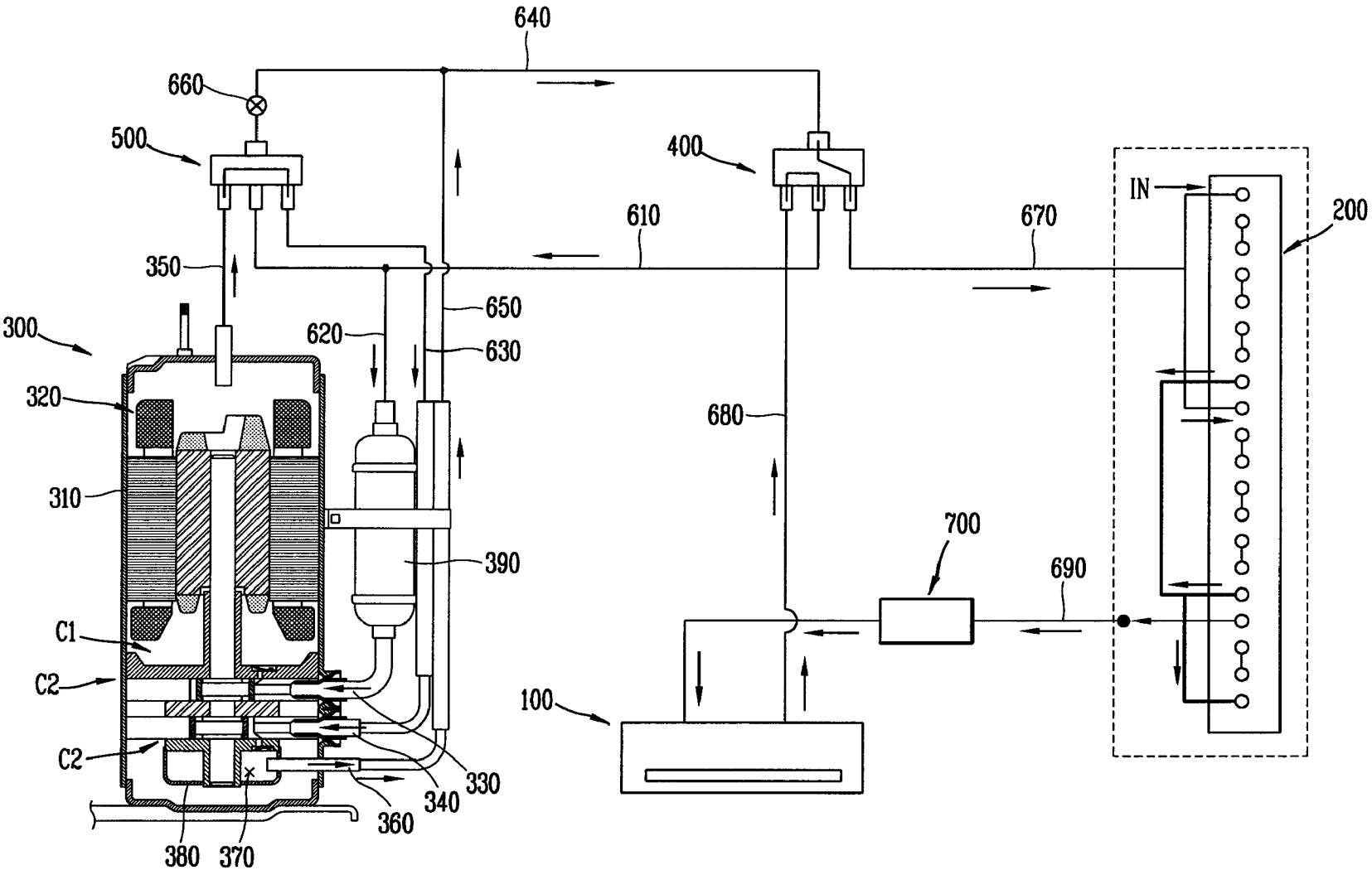

[Fig. 6]
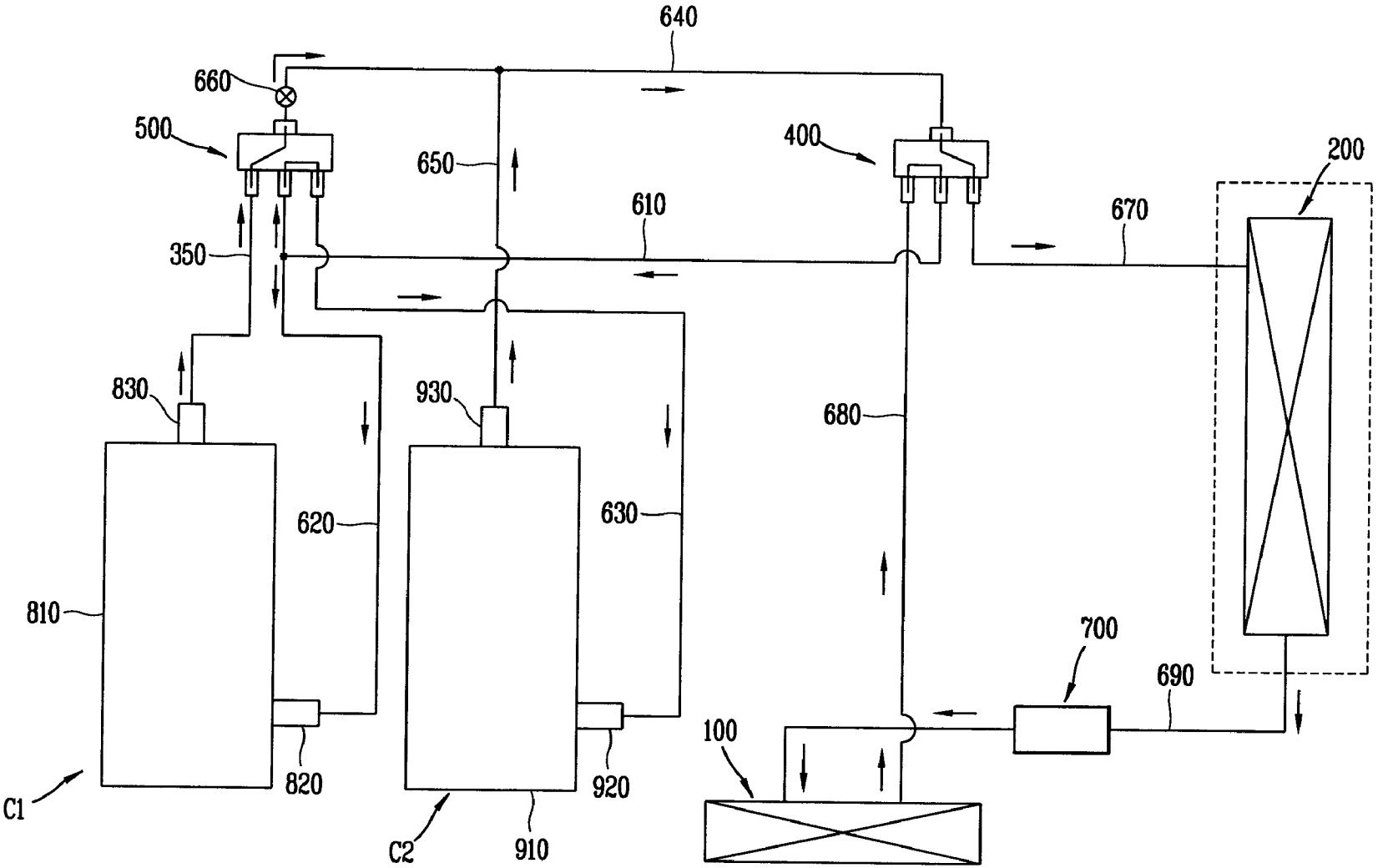

[Fig. 7]
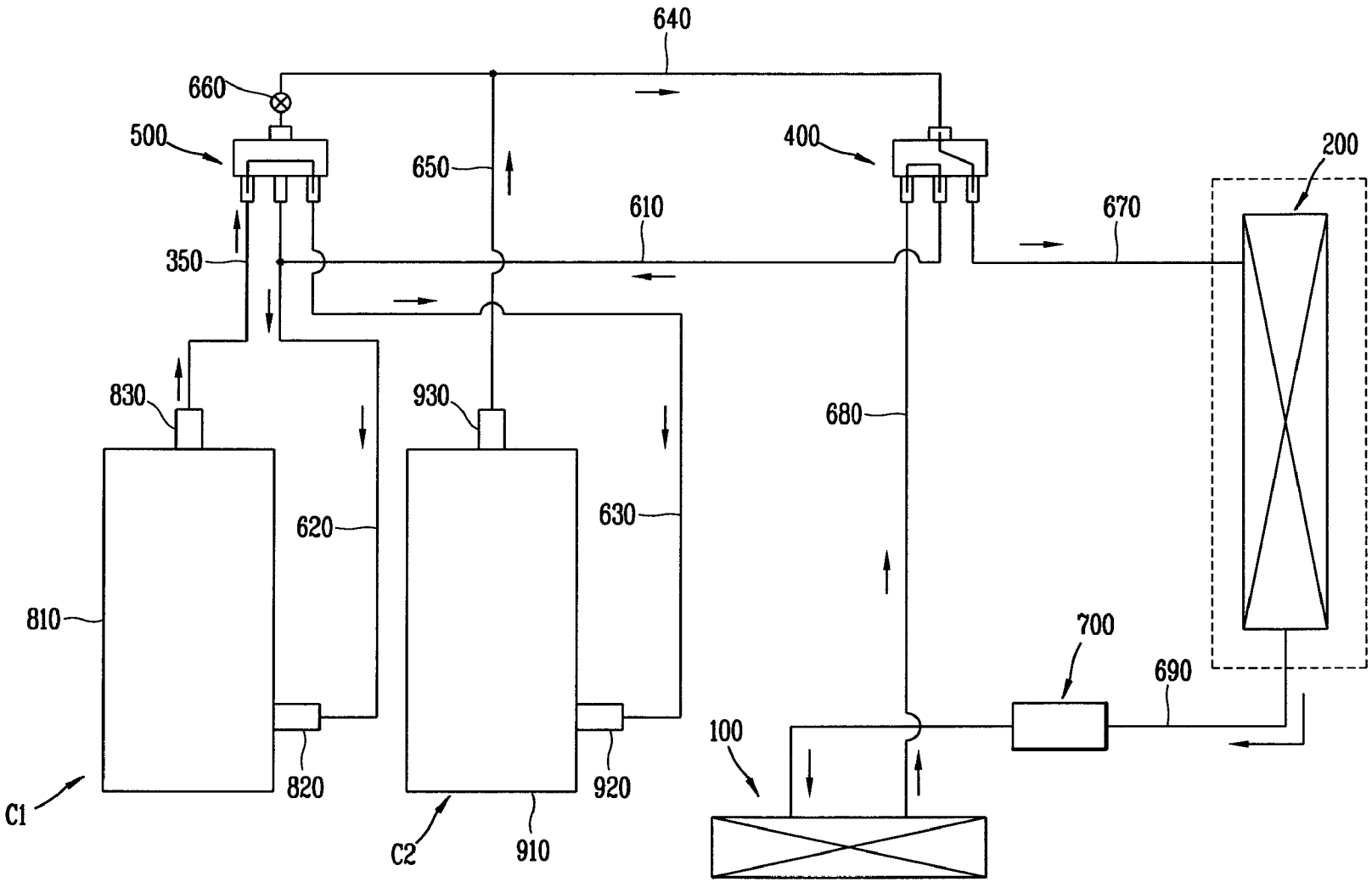

AIR CONDITIONER AND DRIVING METHOD THEREOF

This is a National Phase Application which claims the benefits of PCT/KR2004/003289 filed 14 Dec. 2004, which is hereby incorporated by reference for all purposes as if fully set forth herein.

TECHNICAL FIELD

The present invention relates to an air conditioner and a driving method thereof, and more particularly, to an air conditioner capable of varying a capacity according to a variance of an indoor temperature and capable of minimizing a fabrication cost, and a driving method thereof.

BACKGROUND ART

Generally, an air conditioner maintains an indoor temperature as a preset state thereby to maintain an indoor room as a comfortable state.

The air conditioner includes a refrigerating cycle system. The refrigerating cycle system is composed of: a compressor for compressing a refrigerant; a condenser for condensing the refrigerant compressed in the compressor and emitting heat to outside; an expansion valve for lowering a pressure of the refrigerant condensed by the condenser; and an evaporator for evaporating a refrigerant that has passed through the expansion valve and absorbing external heat.

The compressor, the condenser, the expansion valve, and the evaporator are connected to one another by a connection pipe thereby to form one cycle.

In the refrigerating cycle system, when the compressor is operated as power is supplied to the compressor, a refrigerant of a high temperature and high pressure discharged from the compressor sequentially passes through the condenser, the expansion valve, and the evaporator, and then is sucked into the compressor. The above processes are repeated. During the above process, heat is generated in the condenser, and cool air is formed as the evaporator absorbs external heat. The heat generated in the condenser and the cool air formed in the evaporator are selectively circulated into an indoor room, thereby maintaining the indoor room as a comfortable state.

The air conditioner can be implemented as various shapes according to an installation condition. For example, the air conditioner is mounted in one casing with the refrigerating cycle system, and an air duct and a blowing fan are provided in the casing. The air conditioner is generally installed at a window of an indoor side in order to maintain a relatively small indoor room as a comfortable state.

As another example, the air conditioner is composed of an indoor unit and an outdoor unit. The indoor unit includes a heat exchanger serving as an evaporator at the time of performing an air conditioning. The outdoor unit includes a heat exchanger serving as a condenser at the time of performing an air conditioning, and a compressor. The indoor unit is installed at an indoor room, and the outdoor unit is installed at an outdoor room.

As still another example, the air conditioner is composed of: one outdoor unit; and a plurality of indoor units connected to the outdoor unit and respectively installed at an indoor room. A compressor mounted at the outdoor unit has a great capacity, or two compressors are mounted at the outdoor unit.

Generally, a compressor converts an electric energy into a kinetic energy, and compresses a refrigerant by the kinetic energy. The compressor includes a motor part for generating a driving force; and a compression part for compressing a refrigerant by receiving the driving force of the motor part. The compressor can be divided into a rotary compressor, a scroll compressor, a reciprocal compressor, etc. according to a compression mechanism of a refrigerant.

Among the above compressors, the rotary compressor, the scroll compressor, etc. are mainly used in the air conditioner.

In the fabrication process of the air conditioner, the most important factor is to minimize a fabrication cost for a high competitiveness, and is to minimize an energy consumption at the time of operating the air conditioner.

Especially, as the oil usage amount is increased worldwide and thus the oil price is increased, an air conditioner capable of minimizing an energy consumption is being much required. When the energy consumption of the air conditioner is minimized, the environment pollution is minimized.

In order to minimize the energy consumption of the air conditioner, the air conditioner has to be driven according to a load of an indoor room where the air conditioner is installed, that is, according to a temperature of an indoor room. That is, when a temperature of an indoor room is drastically increased, the air conditioner is driven to generate much cold air in order to maintain a preset indoor temperature. On the contrary, when a temperature of an indoor room is minutely varied, the air conditioner is driven to generate less cold air in order to maintain a preset indoor temperature.

To satisfy the above condition, an amount of a refrigerant discharged from a compressor, a main component for driving a refrigerating cycle system is controlled.

In order to control a discharge amount of a refrigerant from the compressor, an inverter motor for varying an rpm of a driving motor constituting the compressor is used. The rpm of the driving motor of the compressor is controlled according to a condition of an indoor room where the air conditioner is installed, thereby controlling an amount of a refrigerant discharged from the compressor. As the discharge amount of the refrigerant is varied, heat generated in the condenser and cold air generated in the evaporator are controlled.

However, in case of applying the inverter motor to the driving motor of the compressor, the fabrication cost of the air conditioner is increased since the inverter motor is very expensive thereby to lower the price competitiveness.

According to this, it is required to vary a capacity of an air conditioner according to a condition of an indoor room where the air conditioner is installed by controlling an amount of a refrigerant discharged from a compressor under a state that a general motor that is not provided with a control drive is applied to the compressor.

DISCLOSURE OF INVENTION

Technical Problem

Therefore, an object of the present invention is to provide an air conditioner capable of varying a capacity thereof according to a variation of an indoor temperature and capable of minimizing a fabrication cost, and a driving method thereof.

Technical Solution

To achieve these and other advantages and in accordance with the purpose of the present invention, as embodied and broadly described herein, there is provided an air conditioner comprising: a first compression unit and a second compression unit for respectively compressing a refrigerant; an outdoor heat exchanger provided at an outdoor unit and connected to the first compression unit and the second compression unit; an indoor heat exchanger provided at an indoor unit and connected to the first compression unit, the second compression unit, and the outdoor heat exchanger; and a refrigerant guiding means for controlling a refrigerant flow by connecting the first compression unit and the second compression unit in series or in parallel so that a refrigerant can be consecutively or respectively compressed in the first compression unit and in the second compression unit and then discharged.

To achieve these and other advantages and in accordance with the purpose of the present invention, as embodied and broadly described herein, there is also provided a method for driving an air conditioner having a first compression unit and a second compression unit comprising the steps of: starting to drive the air conditioner; selecting a saving mode or a power mode according to a preset condition; controlling a refrigerant flow in series so that a refrigerant can be compressed in the first compression unit and then compressed in the second compression unit at the time of the saving mode; and controlling a refrigerant flow in parallel so that a refrigerant can be respectively compressed in the first compression unit and the second compression unit at the time of the power mode.

The foregoing and other objects, features, aspects and advantages of the present invention will become more apparent from the following detailed description of the present invention when taken in conjunction with the accompanying drawings.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a piping diagram showing a first embodiment of an air conditioner according to the present invention;

FIG. 2 is a piping diagram showing a second embodiment of the air conditioner according to the present invention;

FIG. 3 is a view showing a driving method of the air conditioner according to the present invention;

FIGS. 4 and 5 are piping diagrams respectively showing an operation state of the air conditioner in a power mode and in a saving mode according to the first embodiment of the present invention; and FIGS. 6 and 7 are piping diagrams respectively showing an operation state of the air conditioner in a power mode and in a saving mode according to the second embodiment of the present invention.

BEST MODE

Reference will now be made in detail to the preferred embodiments of the present invention, examples of which are illustrated in the accompanying drawings.

An air conditioner and a driving method of the air conditioner according to the present invention will be explained with reference to the attached drawings as follows.

FIG. 1 is a piping diagram showing a first embodiment of an air conditioner according to the present invention.

As shown, the air conditioner comprises: an indoor unit including an indoor heat exchanger 100 and installed at an indoor room; an outdoor unit including an outdoor heat exchanger 200 and installed at an outdoor room; a first compression unit C1 and a second compression unit C2 installed at the outdoor unit, for respectively compressing a refrigerant; connection pipes for connecting the indoor heat exchanger 100, the outdoor heat exchanger 200, the first compression unit C1, and the second compression unit C2 as one cycle; and a refrigerant guiding means for controlling a refrigerant flow so that a refrigerant can flow to the first compression unit C1 and the second compression unit C2 in series or in parallel.

The first compression unit C1 and the second compression unit C2 are provided in one hermetic container 310, and respectively compress a refrigerant by a driving force of one driving motor 320 mounted in the hermetic container 310. The first compression unit C1 and the second compression unit C2 constitute a two-stage type compressor 300 having a flow path of a refrigerant for sucking a refrigerant to the compression unit C1 and the second compression unit C2 and discharging the refrigerant. The driving motor 320 is a constant speed motor.

The flow path of a refrigerant of the two-stage type compressor 300 includes: a first suction pipe 330 for guiding a refrigerant to be sucked into a compression space of the first compression unit C1; a second suction pipe 340 for guiding a refrigerant to be sucked into a compression space of the second compression unit C2; a first discharge pipe 350 coupled to the hermetic container 310, for discharging a refrigerant discharged from the first compression unit C1 outside the hermetic container 310 via the hermetic container 310, and a second discharge pipe 360 coupled to the hermetic container 310, for discharging a refrigerant discharged from the second compression unit C2 outside the hermetic container 310.

A chamber 370 for containing a refrigerant discharged from the second compression unit C2 is provided between the second compression unit C2 and the second discharge pipe 360. The chamber 370 is formed by a cover 380 coupled to a lower surface of the second compression unit C2.

A second control valve 400 for controlling a refrigerant discharged from a compression unit group including the first compression unit C1 and the second compression unit C2 to selectively flow to the outdoor heat exchanger 200 or the indoor heat exchanger 100 is provided at the connection pipes.

The second control valve 400 is preferably a four-way valve.

The refrigerant guiding means includes: a first control valve 500 for controlling a flow direction of a refrigerant; an inlet connection pipe 610 connected to the first control valve 500, for introducing a refrigerant to the first control valve 500 from the indoor heat exchanger 100 or the outdoor heat exchanger 200, a first connection pipe 620 for connecting the inlet connection pipe 610 to the first suction pipe 330, a suction side of the first compression unit C1; a second connection pipe 630 for connecting the first control valve 500 to the second suction pipe 340, a suction side of the second compression unit C2; an outlet connection pipe 640 connected to the first control valve 500, for discharging a refrigerant to the indoor heat exchanger 100 or the outdoor heat exchanger 200; a third connection pipe 650 for connecting the outlet connection pipe 640 to the second discharge pipe 360, a discharge side of the second compression unit C2; and an open/close valve 660 mounted at the outlet connection pipe 640, for opening and closing a flow channel of a refrigerant.

A discharge side of the first compression unit C1 is connected to the first control valve 500 by the first discharge pipe 350.

The open/close valve 660 is positioned between the first control valve 500 and a connection part between the outlet connection pipe 640 and the third connection pipe 650.

The first control valve 500 is preferably a four-way valve.

The outlet connection pipe 640 connected to the first control valve 500 is connected to the second control valve 400, and the inlet connection pipe 610 connected to the first control valve 500 is connected to the second control valve 400. Also, a fourth connection pipe 670 connected to an inlet of the outdoor heat exchanger 200 is connected to the second control valve 400, and a fifth connection pipe 680 connected to an outlet of the indoor heat exchanger 100 is connected to the second control valve 400.

An outlet side of the outdoor heat exchanger 200 and an inlet side of the indoor heat exchanger 100 are connected to each other by a sixth connection pipe 690. An expansion valve (or a capillary tube) 700 is mounted at the sixth connection pipe 690.

An unexplained reference numeral 390 denotes an accumulator.

FIG. 2 is a piping diagram showing a second embodiment of the air conditioner according to the present invention, in which the same reference numerals were given to the same parts as those of the first embodiment.

As shown, the air conditioner has the first compression unit C1 and the second compression unit C2. The first compression unit C1 and the second compression unit C2 serve as a first compressor and a second compressor, respectively. The first connection unit C1 and the second connection unit C2 are connected to the indoor heat exchanger 100, the outdoor heat exchanger 200, etc. by connection pipes to constitute one cycle. The air conditioner includes a refrigerant guiding means for controlling a refrigerant flow by connecting the first compression unit C1 to the second compression unit C2 in series or in parallel so that a refrigerant can be consecutively or respectively compressed in the first compression unit C1 and in the second compression unit C2 and then discharged.

The compressor includes a driving motor part mounted in the hermetic container and generating a driving force; and a compressing part for compressing a refrigerant by receiving the driving force of the driving motor part. Suction pipes 820 and 920 for sucking a refrigerant are connected to hermetic containers 810 and 910 constituting the first compressor and the second compressor, and discharge pipes 830 and 930 for discharging a compressed refrigerant are connected to the hermetic containers 810 and 910. A driving motor constituting the driving motor part is a constant speed motor. As the compressor, a rotary compressor, a scroll compressor, etc. can be applied.

A second control valve 400 for controlling a refrigerant discharged from a compression unit group including the first compression unit C1 and the second compression unit C2 to selectively flow to the outdoor heat exchanger 200 or the indoor heat exchanger 100 is provided at the connection pipes.

The second control valve 400 is preferably a four-way valve.

The refrigerant guiding means includes: a first control valve 500 for controlling a flow direction of a refrigerant; an inlet connection pipe 610 connected to the first control valve 500, for introducing a refrigerant to the first control valve 500 from the indoor heat exchanger 100 or the outdoor heat exchanger 200; a first connection pipe 620 for connecting the inlet connection pipe 610 to the suction pipe 820 of the first compression unit C1, the first compressor; a second connection pipe 630 for connecting the first control valve 500 to the suction pipe 920 of the second compression unit C2, the second compressor; an outlet connection pipe 640 connected to the first control valve 500, for discharging a refrigerant to the indoor heat exchanger 100 or the outdoor heat exchanger 200, a third connection pipe 650 for connecting the outlet connection pipe 640 to the discharge pipe 930 of the second compression unit C2; and an open/close valve 660 mounted at the outlet connection pipe 640, for opening and closing a flow path of a refrigerant.

The discharge pipe 830 of the first compression unit C1, the first compressor is connected to the first control valve 500 by the first discharge pipe 350.

The open/close valve 660 is positioned between the first control valve 500 and a connection part between the outlet connection pipe 640 and the third connection pipe.

The first control valve 500 is preferably a four-way valve.

The outlet connection pipe 640 connected to the first control valve 500 is connected to the second control valve 400, and the inlet connection pipe 610 connected to the first control valve 500 is connected to the second control valve 400. Also, a fourth connection pipe 670 connected to an inlet of the outdoor heat exchanger 200 is connected to the second control valve 400, and a fifth connection pipe 680 connected to an outlet of the indoor heat exchanger 100 is connected to the second control valve 400.

An outlet side of the outdoor heat exchanger 200 and an inlet side of the indoor heat exchanger 100 are connected to each other by a sixth connection pipe 690. An expansion valve (or a capillary tube) 700 is mounted at the sixth connection pipe 690.

FIG. 3 is a view showing a driving method of an air conditioner according to the present invention.

As shown, a method for driving an air conditioner comprises the steps of: starting to drive the air conditioner; selecting a saving mode or a power mode according to a preset condition; controlling a refrigerant flow in series so that a refrigerant can be compressed in the first compression unit C1 and then compressed in the second compression unit C2 at the time of the saving mode; and controlling a refrigerant flow in parallel so that a refrigerant can be respectively compressed in the first compression unit C1 and the second compression unit C2 at the time of the power mode.

The saving mode and the power mode can be set according to a temperature condition inside a space where the air conditioner is installed or according to a season condition.

The saving mode is to decrease an amount of a refrigerant discharged from a compression unit group including the first compression unit C1 and the second compression unit C2, and the power mode is to relatively increase an amount of a refrigerant discharged from the compression unit group. Generally, the saving mode is applied in spring and autumn, and the power mode is applied in summer.

A refrigerant discharged from the first compression unit C1 and the second compression unit C2 is controlled to be selectively introduced into the outdoor heat exchanger 200 or the indoor heat exchanger 100.

In case that at least two compression units are provided, the compression units are connected in series in a saving mode, and connected in parallel in a power mode.

Hereinafter, the air conditioner and effects of the driving method thereof will be explained as follows.

First, the first embodiment of the air conditioner will be explained. In case of the power mode, as shown in FIG. 4, the inlet connection pipe 610 is connected to the second connection pipe 630, and the first discharge pipe 350 is connected to the outlet connection pipe 640 by controlling the first control valve 500. At the same time, the inlet connection pipe 610 is connected to the fifth connection pipe 680, and the outlet connection pipe 640 is connected to the fourth connection pipe 670 by controlling the second control valve 400.

Under this state, the driving motor 320 of the two-stage compressor is operated, and the first compression unit C1 and the second compression unit C2 are operated by receiving the driving force of the driving motor 320. As the first compression unit C1 and the second compression unit C2 are operated, a refrigerant that has passed through the indoor heat exchanger 100 flows through the fifth connection pipe 680 and the inlet connection pipe 610. A part of the refrigerant flowing through the inlet connection pipe 610 is sucked into the compression space of the first compression unit C1 through the first connection pipe 620 and the first suction pipe 330. Also, the rest part of the refrigerant flowing through the inlet connection pipe 610 is sucked into the compression space of the second compression unit C2 through the second connection pipe 630 and the second suction pipe 340.

The refrigerant that has been sucked into the compression space of the first compression unit C1 is compressed in the first compression unit C1 and is discharged, thereby being discharged to the outlet connection pipe 640 through the inside of the hermetic container 310 and the first discharge pipe 350. At this time, the open/close valve 660 is opened.

Also, the refrigerant that has been sucked into the compression space of the second compression unit C2 is compressed in the second compression unit C2 and is discharged, thereby being introduced into the outlet connection pipe 640 through the chamber 370, the second discharge pipe 360, and the third connection pipe 650.

The refrigerant compressed in the first compression unit C1 and the refrigerant compressed in the second compression unit C2 are introduced into the outdoor heat exchanger 200 through the outlet connection pipe 640 and the fourth connection pipe 670. The refrigerant that has passed through the outdoor heat exchanger 200 is introduced into the indoor heat exchanger 100 through the sixth connection pipe 690, and the refrigerant that has passed through the indoor heat exchanger 100 is introduced into the inlet connection pipe 610 through the fifth connection pipe 680.

The refrigerant that has been introduced into the inlet connection pipe 610 circulates a cycle with repeating the above processes. As the above processes are repeated, the outdoor heat exchanger 200 emits heat outwardly, and the indoor heat exchanger 100 absorbs external heat thereby to form cool air.

At the time of the power mode, under a state that the first compression unit C1 and the second compression unit C2 are connected to each other in parallel, a refrigerant is respectively compressed in the first compression unit C1 and the second compression unit C2 and then is discharged, thereby relatively increasing a discharge amount of a refrigerant.

When the power mode is applied to a heating operation, the outlet connection pipe 640 is connected to the fifth connection pipe 680, and the inlet connection pipe 610 is connected to the fourth connection pipe 670 by controlling the second control valve 400. At this time, the outdoor heat exchanger 200 serves as an evaporator, and the indoor heat exchanger 100 serves as a condenser, thereby emitting heat outwardly from the indoor heat exchanger 100.

At the time of the saving mode, as shown in FIG. 5, the first discharge pipe 350 is connected to the second connection pipe 630, and a port of the first control valve 500 connected to the inlet connection pipe 610 is blocked by controlling the first control valve 500. Then, the open/close valve 660 is closed. At the same time, the inlet connection pipe 610 is connected to the fifth connection pipe 680, and the outlet connection pipe 640 is connected to the fourth connection pipe 670 by controlling the second control valve 400.

Under this state, when the driving motor 320 of the two-stage compressor is operated, the first compression unit C1 and the second compression unit C2 are operated by receiving the driving force of the driving motor 320. As the first compression unit C1 and the second compression unit C2 are operated, a refrigerant that has passed through the indoor heat exchanger 100 flows through the fifth connection pipe 680 and the inlet connection pipe 610. The refrigerant flowing through the inlet connection pipe 610 is sucked into the compression space of the first compression unit C1 through the first connection pipe 620 and the first suction pipe 330.

The refrigerant that has been sucked into the compression space of the first compression unit C1 is compressed in the first compression unit C1 and is discharged, thereby being introduced into the second connection pipe 630 through the inside of the hermetic container 310 and the first discharge pipe 350. Then, the refrigerant is sucked into the compression space of the second compression unit C2 through the second suction pipe 340.

The refrigerant that has been sucked into the compression space of the second compression unit C2 is compressed in the second compression unit C2 and is discharged, thereby being introduced into the outlet connection pipe 640 through the chamber 370, the second discharge pipe 360, and the third connection pipe 650.

The refrigerant flowing through the outlet connection pipe 640 is introduced into the outdoor heat exchanger 200 through the fourth connection pipe 670. The refrigerant that has been introduced into the outdoor heat exchanger 200 is introduced into the indoor heat exchanger 100 through the sixth connection pipe 690. Then, the refrigerant introduced into the indoor heat exchanger 100 is introduced into the inlet connection pipe 610 through the fifth connection pipe 680.

The refrigerant that has been introduced into the inlet connection pipe 610 circulates a cycle with repeating the above processes. As the above processes are repeated, the outdoor heat exchanger 200 emits heat outwardly, and the indoor heat exchanger 100 absorbs external heat thereby to form cool air.

At the time of the saving mode, under a state that the first compression unit C1 and the second compression unit C2 are connected to each other in series, a refrigerant is consecutively compressed in the first compression unit C1 and in the second compression unit C2 and then is discharged, thereby relatively decreasing a discharge amount of a refrigerant.

When the saving mode is applied to a heating operation, the outlet connection pipe 640 is connected to the fifth connection pipe 680, and the inlet connection pipe 610 is connected to the fourth connection pipe 670 by controlling the second control valve 400. At this time, the outdoor heat exchanger 200 serves as an evaporator, and the indoor heat exchanger 100 serves as a condenser, thereby emitting heat outwardly from the indoor heat exchanger 100.

An operation of the air conditioner according to the second embodiment of the present invention will be explained as follows.

At the time of a power mode for a cooling operation, as shown in FIG. 6, the inlet connection pipe 610 is connected to the second connection pipe 630, and the first discharge pipe 350 is connected to the outlet connection pipe 640 by controlling the first control valve 500. The open/close valve 660 is opened. At the same time, the inlet connection pipe 610 is connected to the fifth connection pipe 680, and the outlet connection pipe 640 is connected to the fourth connection pipe 670 by controlling the second control valve 400.

Under this state, when the first compressor and the second compressor are operated as power is applied to the first compressor, the first compression unit C1 and the second compressor, the second compression unit C2, the refrigerant that has passed through the indoor heat exchanger 100 flows through the fifth connection pipe 680 and the inlet connection pipe 610. A part of the refrigerant flowing through the inlet connection pipe 610 is sucked into the first compression unit C1 through the first connection pipe 620. Also, the rest part of the refrigerant flowing through the inlet connection pipe 610 is sucked into the second compression unit C2 through the second connection pipe 630.

The refrigerant that has been sucked into the first compression unit C1 is compressed in the first compression unit C1 and is discharged, thereby being discharged to the outlet connection pipe 640 through the first discharge pipe 350.

Also, the refrigerant that has been sucked into the second compression unit C2 is compressed in the second compression unit C2 and is discharged thereby being introduced into the outlet connection pipe 640 through the third connection pipe 650.

The refrigerant compressed in the first compression unit C1 and the refrigerant compressed in the second compression unit C2 are introduced into the outdoor heat exchanger 200 through the outlet connection pipe 640 and the fourth connection pipe 670. The refrigerant that has passed through the outdoor heat exchanger 200 is introduced into the indoor heat exchanger 100 through the sixth connection pipe 690, and the refrigerant that has passed through the indoor heat exchanger 100 is introduced into the inlet connection pipe 610 through the fifth connection pipe 680.

The refrigerant that has been introduced into the inlet connection pipe 610 circulates a cycle with repeating the above processes. As the above processes are repeated, the outdoor heat exchanger 200 emits heat outwardly, and the indoor heat exchanger 100 absorbs external heat thereby to form cool air.

At the time of the power mode for a cooling operation, under a state that the first compression unit C1 and the second compression unit C2 are connected to each other in parallel, a refrigerant is respectively compressed in the first compression unit C1 and the second compression unit C2 and then is discharged, thereby relatively increasing a discharge amount of a refrigerant.

When the power mode is applied to a heating operation, the second control valve 400 is adjusted in the same manner as the aforementioned manner.

At the time of the saving mode for a cooling operation, as shown in FIG. 7, the first discharge pipe 350 is connected to the second connection pipe 630, and a port of the first control valve 500 connected to the inlet connection pipe 610 is blocked by controlling the first control valve 500. Then, the open/close valve 660 is closed. At the same time, the inlet connection pipe 610 is connected to the fifth connection pipe 680, and the outlet connection pipe 640 is connected to the fourth connection pipe 670 by controlling the second control valve 400.

Under this state, when the first compressor, the first compression unit C1 and the second compressor, the second compression unit C2 are operated as power is supplied thereto, a refrigerant that has passed through the indoor heat exchanger 100 is sucked into the first compressor via the fifth connection pipe 680, the inlet connection pipe 610, and the first connection pipe 620.

The refrigerant sucked into the first compressor is compressed in the first compressor and is discharged, thereby being sucked into the second compressor through the first discharge pipe 350 and the second connection pipe 630. The refrigerant compressed in the second compressor and discharged is introduced into the inlet connection pipe 640 through the third connection pipe 650.

The refrigerant that has been introduced into the outlet connection pipe 640 is introduced into the outdoor heat exchanger 200 through the fourth connection pipe 670. Then, the refrigerant that has been introduced into the outdoor heat exchanger 200 is introduced into the indoor heat exchanger 100 through the sixth connection pipe 690, and then is introduced into the inlet connection pipe 610 through the fifth connection pipe 680.

The refrigerant that has been introduced into the inlet connection pipe 610 circulates a cycle with repeating the above processes. As the above processes are repeated, the outdoor heat exchanger 200 emits heat outwardly, and the indoor heat exchanger 100 absorbs external heat thereby to form cool air.

At the time of the saving mode, under a state that the first compression unit C1 and the second compression unit C2 are connected to each other in series, a refrigerant is consecutively compressed in the first compression unit C1 and in the second compression unit C2 and then is discharged, thereby relatively decreasing a discharge amount of a refrigerant.

When the saving mode is applied to a heating operation, the second control valve 400 is adjusted in the same manner as the aforementioned manner.

INDUSTRIAL APPLICABILITY

As aforementioned, according to the air conditioner and the driving method thereof according to the present invention, the air conditioner is driven by varying a capacity according to a temperature change or a season change, thereby decreasing a consumption power of the air conditioner. According to this, a user's satisfaction degree is enhanced and a price competitiveness is high.

Also, since the capacity of the air conditioner is varied with using a cheap constant speed motor, the fabrication cost is decreased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. An air conditioner comprising:

a first compression unit and a second compression unit for compressing a refrigerant;

an outdoor heat exchanger provided at an outdoor unit and connected to the first compression unit and the second compression unit;

an indoor heat exchanger provided at an indoor unit and connected to the first compression unit, the second compression unit, and the outdoor heat exchanger; and a refrigerant guiding means for controlling a refrigerant flow by selectively connecting the first compression unit and the second compression unit in series or in parallel so that a refrigerant can be consecutively or respectively compressed in the first compression unit and in the second compression unit and then discharged, wherein the refrigerant guiding means includes:

a first control valve for controlling a flow direction of a refrigerant;

an inlet connection pipe connected to the first control valve;

a first connection pipe connected to a suction side of the first compression unit;

a first discharge pipe for connecting a discharge side of the first compression unit and the first control valve;

a second connection pipe for connecting the first control valve to a suction side of the second compression unit;

an outlet connection pipe connected to the first control valve;

a third connection pipe connected to a discharge side of the second compression unit; and an open/close valve mounted at the outlet connection pipe, for opening and closing a flow path of a refrigerant.

2. The air conditioner of claim 1, wherein the first compression unit is a first compressor including:

a driving motor part mounted in a hermetic container for generating a driving force; and a compression part for compressing a refrigerant by receiving a driving force of the driving motor part, and the second compression unit is a second compressor including:

a driving motor part mounted in a hermetic container for generating a driving force; and a compression part for compressing a refrigerant by receiving a driving force of the driving motor part.

3. The air conditioner of claim 2, wherein the driving motor part is rotated with a constant speed.

4. The air conditioner of claim 1, wherein the first compression unit and the second compression unit are provided in one hermetic container, respectively compress a refrigerant by receiving a driving force of one driving motor, and constitute a two-stage type compressor having a flow path of a refrigerant through which a refrigerant is sucked into the first compression unit and the second compression unit and then is discharged.

5. The air conditioner of claim 4, wherein the driving motor is a constant speed motor.

6. The air conditioner of claim 4, wherein the flow path of a refrigerant of the two-stage type compressor includes:

a first suction pipe for guiding a refrigerant to be sucked into a compression space of the first compression unit;

a second suction pipe for guiding a refrigerant to be sucked into a compression space of the second compression unit;

a first discharge pipe coupled to the hermetic container, for discharging a refrigerant discharged from the first compression unit outside the hermetic container via the hermetic container; and a second discharge pipe coupled to the hermetic container, for discharging a refrigerant discharged from the second compression unit outside the hermetic container.

7. The air conditioner of claim 6, wherein a chamber for containing a refrigerant discharged from the second compression unit is provided between the second compression unit and the second discharge pipe.

8. The air conditioner of claim 1, wherein the open/close valve is positioned between the first control valve and a connection part between the outlet connection pipe and the third connection pipe.

9. The air conditioner of claim 1, wherein the first control valve is a four-way valve.

10. The air conditioner of claim 1, further comprising;

a second control valve connected to the outlet connection pipe and the inlet connection pipe for controlling a refrigerant discharged from a compression unit group to selectively flow to the outdoor heat exchanger or the indoor heat exchanger, wherein the compression unit group includes the first compression unit and the second compression unit.

11. The air conditioner of claim 10, wherein the second control valve is a four-way valve.

12. A method for driving the air conditioner of claim 1, comprising the steps of:

starting to drive the air conditioner;

selecting a saving mode or a power mode according to a preset condition;

controlling a refrigerant flow in series so that a refrigerant is compressed in the first compression unit and then compressed in the second compression unit at the time of the saving mode; and controlling a refrigerant flow in parallel so that a refrigerant is respectively compressed in the first compression unit and in the second compression unit at the time of the power mode.

13. The method of claim 12, wherein a refrigerant discharged from the first compression unit and the second compression unit is controlled to selectively flow to the outdoor heat exchanger or the indoor heat exchanger.

14. The method of claim 12, wherein the compression units are connected to one another in series in the saving mode and are connected to one another in parallel in the power mode.

* * * * *